US010285431B2

(12) United States Patent
Mishra et al.

(10) Patent No.: US 10,285,431 B2
(45) Date of Patent: May 14, 2019

(54) ENCAPSULATED FLAVORANT DESIGNED FOR THERMAL RELEASE AND CIGARETTE BEARING THE SAME

(75) Inventors: Munmaya K. Mishra, Richmond, VA (US); Jay A Fournier, Richmond, VA (US); Kathy E. Paine, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 420 days.

(21) Appl. No.: 11/025,804

(22) Filed: Dec. 30, 2004

(65) Prior Publication Data

US 2006/0144412 A1 Jul. 6, 2006

(51) Int. Cl.
*A24B 15/28* (2006.01)

(52) U.S. Cl.
CPC ..... *A24B 15/283* (2013.01)

(58) Field of Classification Search
None
See application file for complete search history.

(56) References Cited

U.S. PATENT DOCUMENTS

| | | | |
|---|---|---|---|
| 2,800,457 | A | 7/1957 | Green et al. |
| 2,969,330 | A | 1/1961 | Brynko |
| 3,015,128 | A | 1/1962 | Somerville, Jr. |
| 3,041,289 | A | 6/1962 | Katchen et al. |
| 3,577,515 | A | 5/1971 | Vandegaer |
| 3,658,069 | A | 4/1972 | Wise et al. |
| 4,889,144 | A | 12/1989 | Tateno et al. |
| 4,956,128 | A | 9/1990 | Hommel et al. |
| 5,000,198 | A | 3/1991 | Nakajima |
| 5,144,966 | A | 9/1992 | Washington |
| 5,186,185 | A | 2/1993 | Mashiko et al. |
| 5,221,502 | A | 6/1993 | Washington |
| 5,292,533 | A | 3/1994 | McMahon et al. |
| 5,456,937 | A | 10/1995 | Chalupa |
| 5,499,636 | A | 3/1996 | Baggett, Jr. et al. |
| 5,578,314 | A | 11/1996 | Cochrum et al. |
| 5,614,217 | A | 3/1997 | Chiprich et al. |
| 5,666,976 | A | 9/1997 | Adams et al. |
| 5,692,525 | A | 12/1997 | Counts et al. |
| 5,692,526 | A | 12/1997 | Adams et al. |
| 5,744,337 | A | 4/1998 | Price et al. |
| 5,915,387 | A | 6/1999 | Baggett, Jr. et al. |
| 5,988,176 | A | 11/1999 | Baggett, Jr. et al. |
| 6,026,820 | A | 2/2000 | Baggett, Jr. et al. |
| 6,135,121 | A | 10/2000 | Williams |
| 6,325,859 | B1 | 12/2001 | De Roos et al. |
| 6,410,050 | B1 | 6/2002 | Yang |

(Continued)

FOREIGN PATENT DOCUMENTS

| | | |
|---|---|---|
| EP | 0 464 324 A2 | 4/1991 |
| EP | 0 464 324 B1 | 4/1991 |

(Continued)

*Primary Examiner* — Michael J Felton
(74) *Attorney, Agent, or Firm* — Buchanan Ingersoll & Rooney LLP

(57) ABSTRACT

Improved delivery of additives is provided through encapsulation. The encapsulated additives can be formed by encapsulating additives using co-ionic cross-linking, in-situ overcoating, and/or step-growth overcoating. By encapsulating additives, additives can be made heat and moisture stable and migration and/or loss of the additives within a cigarette, such as an activated carbon containing cigarette, can be reduced.

11 Claims, 3 Drawing Sheets

(56) References Cited

U.S. PATENT DOCUMENTS

| | | | |
|---|---|---|---|
| 6,436,461 | B1 | 8/2002 | Bouwmeesters et al. |
| 6,475,288 | B1 | 11/2002 | Oliver |
| 6,584,979 | B2 | 7/2003 | Xue et al. |
| 6,689,467 | B1 | 2/2004 | Joubert et al. |
| 6,733,790 | B1 | 5/2004 | Garces Garces |
| 6,772,768 | B2 | 8/2004 | Xue et al. |
| 6,779,528 | B2 | 8/2004 | Xue et al. |

FOREIGN PATENT DOCUMENTS

| | | | |
|---|---|---|---|
| EP | 0 628 260 | A2 | 6/1994 |
| EP | 0 628 260 | A3 | 6/1994 |
| FR | 1 574 645 | | 7/1969 |
| GB | 1 349 537 | | 4/1974 |
| WO | WO 93/19622 | | 10/1993 |
| WO | WO 00/33676 | A1 | 6/2000 |
| WO | WO 03/041521 | A2 | 5/2003 |
| WO | WO 03/041521 | A3 | 5/2003 |

ENCAPSULATED FLAVORANT DESIGNED FOR THERMAL RELEASE AND CIGARETTE BEARING THE SAME

BACKGROUND

Flavorants are frequently added to tobacco products to achieve desirable taste sensations. One of the more common flavorants is menthol due to its mint flavoring and cooling effects that can be imparted to tobacco smoke. However, due to the high volatility of menthol, which causes menthol to vaporize and gradually escape from the tobacco product during storage, controlling the concentration of menthol in a tobacco product is difficult.

The use of menthol is especially problematic when used in tobacco products, such as cigarettes, in combination with sorbent materials. Sorbent materials are generally employed in tobacco products to remove selected constituents of tobacco smoke. The more common sorbent materials include activated carbons and zeolites.

Activated carbons are useful sorbent materials since they have a large adsorbent capacity for a low cost. However, while activated carbons are effective in removing targeted constituents of tobacco smoke, they lack selectivity and can also adsorb flavorants, such as menthol, present in the smoking article. This adsorption of flavorants is not only detrimental to the level of flavoring ultimately passed to an end user of the tobacco product, but is also detrimental to the activated carbon itself. Through adsorbing the flavorant, the activated carbon can become deactivated by the adsorbed flavorants as the adsorbed flavorants can fill available adsorbent sites within the activated carbon reducing the adsorbency of the activated carbon.

Accordingly, there is interest in providing additives, such as flavorants, in tobacco products containing sorbent materials, wherein the additives are protected from sorption by the sorbent materials.

SUMMARY

In an embodiment, an encapsulated flavorant, comprising: a flavorant; an encapsulating cross-linked polymer with the flavorant therein, wherein the encapsulated cross-linked polymer forms a polymer-rich outer region and the flavorant forms a flavorant-rich core region; and an overcoating cross-linked polymer layer on the encapsulating cross-linked polymer with the flavorant therein is provided.

In another embodiment, a cigarette, comprising: a filter including a sorbent on one end of the cigarette; a tobacco rod or a tobacco mat on the other end of the cigarette; and one or more encapsulated additives within a tobacco filler of the tobacco rod or on a surface of the tobacco mat, wherein the one or more encapsulated additives comprise: a flavorant; an encapsulating cross-linked polymer with the flavorant therein, wherein the encapsulated cross-linked polymer forms a polymer-rich outer region and the flavorant forms a flavorant-rich core region; and an overcoating cross-linked polymer layer around the encapsulating cross-linked polymer with the flavorant therein is provided.

In another embodiment, a method of forming multi-layered encapsulated flavorant, comprising: forming a mixture of a flavorant and a first encapsulant solution; adding the mixture to a first cross-linking solution to form an encapsulated flavorant; adding the encapsulated flavorant to a second encapsulant solution to form an uncross-linked encapsulant layer on the encapsulated flavorant; and adding the uncross-linked encapsulant layered encapsulated flavorant to a second cross-linking solution to form a cross-linked overcoating layer on the encapsulated flavorant is provided.

In another embodiment, a method of making an encapsulated menthol additive by at least a partial in-situ overcoating, comprising: forming a mixture of menthol additive and a solution of one or more multivalent cations; and reacting the mixture with a solution of one or more polymers, wherein the solution of one or more polymers reacts with the one or more multivalent cations to encapsulate the menthol and form an encapsulated menthol additive with a menthol additive-rich core region within a polymer-rich outer region is provided.

In another embodiment, a method of providing encapsulated menthol additive formed by co-ionic cross-linking in a tobacco rod portion of a cigarette comprising: forming a mixture of menthol, oil and two or more polymers in water; reacting the mixture with a solution of one or more multivalent cations to co-ionically cross-link the two or more polymers with each other forming a menthol-rich core region within a co-ionically cross-linked polymer-rich outer region to form an encapsulated menthol additive; and incorporating the encapsulated menthol additive in the tobacco rod portion of the cigarette is provided.

DETAILED DESCRIPTION

Figure 1:
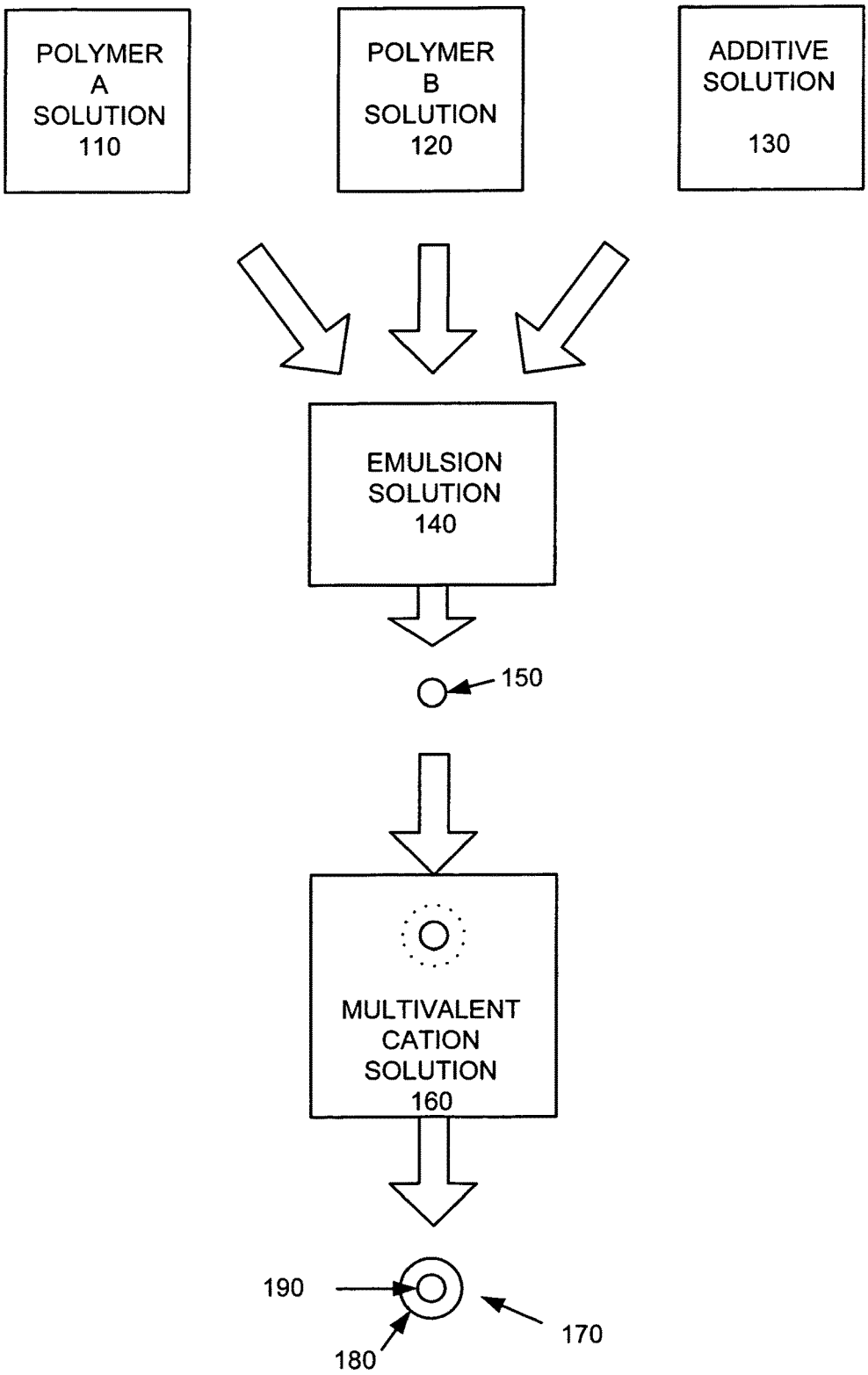
FIG. 1 is a simplified illustration of an exemplary co-ionic cross-linking encapsulation method.

In order to prevent sorption of additives by sorbents in a tobacco product, methods of encapsulating additives are disclosed herein. Preferred methods, such as co-ionic cross-linking, in-situ overcoating and/or step-growth layering, provide additive resistance to migration, as well as additive resistance to sorption by sorbents. Preferably, through the use of encapsulation, encapsulated additives are formed which are structurally stable, as well as heat and moisture stable. Also preferably, release of additives does not occur through melting or an application of mechanical force, but rather when the encapsulated additive is heated to the point where at least part of the encapsulant is at least partially degraded or destroyed by burning of the encapsulant.

As used herein, "heated" or "heating" is intended to include elevating the temperature of an encapsulated additive to the point at which volatilization, thermal degradation, combustion, pyrolyzation, etc. occur such that the encapsulant releases the additive through at least partial degradation of at least a portion of the encapsulant rather than by melting of the encapsulant.

Through encapsulating additives using these methods, not only can heat and structural stability be attained, but also high levels of additives can be encapsulated. For example, menthol levels as high as 60 or 70 wt % can be encapsulated by the methods discussed herein.

Preferably, the encapsulated additives are added to smoking articles, such as cigarettes, so as to provide additives to mainstream smoke while overcoming the migration disadvantages caused by providing additives alone. Preferably, the encapsulated additives are provided in a heating zone, wherein the encapsulated additive can be heated to at least partially degrade the encapsulant.

Also preferably, the smoking article is embodied by a sorbent and encapsulated additive containing cigarette. By providing a sorbent, such as activated carbon, the smoking article can have reduced levels of targeted constituents of mainstream smoke, such as benzene, acrolein or 1,3-butadiene. By providing encapsulated additive, the interaction between the additive and the sorbent can be reduced thus allowing the additive to be released into the mainstream smoke upon heating with reduced sorption of the additive by the sorbent.

Encapsulation

Stable encapsulated additives can be formed through encapsulation of additives by polymer co-ionic cross-linking, in-situ overcoating and/or step-growth layering. Preferably, the encapsulation is cross-linked in order to provide heat and structural stability, as well as provide a matrix within which additives can be encapsulated. Through cross-linking the encapsulation is preferably melt-resistant and shear-resistant in that if the encapsulation is subjected to levels of heat sufficient to cause at least partial degradation or is subjected to mechanical forces such that the encapsulated additive is sheared, the encapsulant will continue to encapsulate the additive and release will not occur.

The term "encapsulation" includes both encapsulation and microencapsulation of one material by another material. For example, encapsulation preferably includes forming a matrix of one material wherein a second material is microencapsulated within the matrix of the first material. Likewise, "encapsulated additives" refers to additives, such as flavorants like menthol, in three-dimensional networks or matrices of cross-linked encapsulant, wherein the encapsulated additives are formed by polymer co-ionic cross-linking, in-situ over-coating and/or step-growth layering.

1. Encapsulant Components

The encapsulant material is preferably a cross-linkable polymer material capable of encapsulating an additive therein. Preferably, the encapsulant material is one or more polymers, wherein the one or more polymers are cross-linked to form three-dimensional cross-linked polymer chain networks for heat and structural stability. Through cross-linking, the polymer chain networks are ionically tied together and therefore cannot flow or melt, thus providing a heat stable and a structurally stable encapsulant.

Preferred polymers used for encapsulant include polysaccharides. While other polymers can be used, preferably the encapsulant polymers are biocompatible, non-toxic and hypo-allergenic. For example, encapsulants that cause allergic reactions, such as casein, would be less preferred because casein is a milk protein and may cause an allergic reaction by lactose intolerant users.

Polysaccharides are preferred because they can be made water insoluble and relatively heat stable at lower temperatures (e.g., below about 75° C.) through cross-linking. Further, cross-linked polysaccharides are cross-linked by salt bridges between polysaccharide chains which can maintain the stability and shape of the encapsulated additives. Additionally, polysaccharides are also preferred because polysaccharides can be heated and burned to yield tasteless products, thus allowing for additives encapsulated therein to be released upon heating without altering a taste of the additive.

The encapsulated additives can also include filler polymers to decrease the porosity of the encapsulant, wherein filler polymers can be used to fill naturally occurring voids and fissures between polymer chains and cross-links in the encapsulant. Preferably, filler polymers include other polysaccharides, such as xanthan gum, or synthetic polymers, such as polyethylene glycol. It is noted that the filler polymers do not cross-link with the encapsulant polymers, thus decreasing the porosity of the encapsulant by simply filling in spaces within the cross-linked encapsulant.

The encapsulated additives can also include emulsifiers to aid in the emulsification of the additive into a solution for encapsulation. For example, for hydrophobic additives, such as menthol, hydrophobic emulsifiers, such as oil or propylene glycol, can be used.

The encapsulated additives can also include diluents for the additive to provide less concentrated additives for encapsulation. For example, if menthol is used for the additive, diluents like glycerine can be used.

2. Encapsulant Reaction

In order to cross-link encapsulating polymers, such as polysaccharides, multivalent cations are used to form salt bridges therein. These salt bridges cross-link the encapsulating polymers resulting in a three-dimensional network or "matrix" of polymer chains and salt bridges.

Preferably, multivalent cations are used in solution, e.g., an aqueous or alcoholic solution with multivalent cations therein. Preferred multivalent cations for use with polysaccharides include calcium, iron, aluminum, manganese, copper, zinc, lanthanum, most preferably calcium. Preferably, the multivalent cations are provided in multivalent solutions with multivalent metal salts, such as lanthanum or calcium salts. Preferably, calcium salts, such as calcium acetate, calcium chloride or other calcium salts are provided in the multivalent solutions.

Additionally, the levels of hardness of the encapsulant can be controlled through the cross-linking process, wherein more cross-links lead to harder encapsulants while fewer cross-links lead to softer encapsulants. Therefore, depending upon the amount of reaction between the polysaccharides and the multivalent cations and thus the number of salt bridges restraining movement of the polysaccharide polymer chains, the hardness of the encapsulant can be controlled. For example, if multivalent cations react with polysaccharides briefly, a gel can be formed. However, if multivalent cations are reacted with polysaccharides for a longer reaction time, solid particles may form.

It is noted that in addition to cross-linking, encapsulated additives may also use surface segregation to reduce leakage of additive from the encapsulant. Surface segregation can be implemented by using hydrophilic polymers, such as polysaccharides, in water base solutions with hydrophobic additives, such as menthol. It is believed that the hydrophobic additive will aggregate away within the hydrophilic polymer and away from the water base solution, thus forming an inner hydrophobic additive-rich portion within an outer hydrophilic polymer-rich portion. It is believed that this occurs because the hydrophobic additive-rich portion will be repelled from the water base solution, and to a lesser degree the hydrophilic polymer, thus causing surface segregation with the hydrophilic polymer being between the hydrophobic additive and the water base solution.

Methods of Encapsulation

1. Co-ionic Cross-linking

Co-ionic cross-linking ("CICL") is intended herein to include cross-linking of more than one polymer in a single cross-linking step. In other words, CICL is intended to include two or more distinct polymers, which are subjected to cross-linking with one another. CICL allows for control over the porosity, i.e., the amount of voids and fissures within a cross-linked polymer mass of an encapsulant polymer-rich layer, by having polymer chains of different polymers cross-linked to one another.

Preferably, the co-ionically cross-linkable polymers are polysaccharides for the reasons discussed above including biocompatibility and tastelessness upon heating. Of the polysaccharides used for encapsulating additives, preferably alginate and pectin are used as they are able to co-ionically cross-link with one another. By using co-ionically cross-linkable polymers, a heat and structurally stable encapsulant can be formed, as discussed above, but also voids and fissure of a first polymer, such as the alginate, can be filled by a second co-ionically cross-linked polymer, such as the pectin, wherein the polymer chains of the alginate and pectin happen to be complementary to one another thereby reducing the porosity of the encapsulant.

For example, as illustrated in FIG. 1, an additive solution 130, such as an emulsion of menthol and oil, is formed for mixture with two hydrophilic polymer solutions, each of which includes a different polymer from the other solution. Preferably, the hydrophilic polymer solutions include water-soluble polymers, such as alginate and pectin, in a water solution. Next, a polymer A solution 110 is mixed with a polymer B solution 120 and the additive solution 130 to form an emulsion solution 140. The emulsion solution 140 can also include an emulsifying agent, if desired, to emulsify the additive within the emulsion solution 140.

Next, the emulsion solution 140 is stirred at high speeds such that the emulsion solution 140 approaches a homogeneous mixed state. Next, the relatively homogenized mixture 140 is used to form droplets 150. The droplets 150 are preferably formed by hand with a syringe or using a machine, such as an Inotech bead maker manufactured by Inotech AG of Dottikon, Switzerland, wherein each droplet can be between 100 μm to 1000 μm in diameter, preferably about 250 μm.

Upon formation of the droplets 150, each droplet undergoes surface segregation forming an additive-rich core and an encapsulant-rich outer layer. This occurs because the additive solution 130 includes a hydrophobic or water repelling additive and emulsifier, while the polymer solutions include water soluble, hydrophilic or water absorbing polymers in a water base solution. Therefore, inherently due to the interaction between the hydrophobic additive solution, the hydrophilic polymers and the water base solution, surface segregation will occur. The surface segregation results in the hydrophobic additive forming an additive-rich core region within a polymer-rich outer region within each droplet.

Next, each droplet 150 (or any other formation, wherein a droplet is used herein for illustrative purposes) of the emulsion solution 140 is cross-linked through interaction with multivalent cations in a multivalent cation solution 160, which is illustrated for exemplary purposes as a droplet immersed in solution. It is noted that the emulsion solution 140 can alternatively be sprayed onto a surface, and then reacted with the multivalent cation solution by spraying the multivalent cation solution onto the mixture. Preferably, the multivalent cation solution includes a water base multivalent cation solution, such as calcium chloride in a solution of water, as mentioned above.

As a result of the contact between the droplet 150 and the multivalent cation solution 160, cross-linking of the polymers occurs, or more specifically, cross-linking of the polymer-rich outer region of the droplet 150 occurs using the cations from the multivalent cation solution 160. It is noted that the cross-linking reaction of the polymers caused by the multivalent cations can be completed in just a few seconds, i.e., 1-10 seconds. As a result of the reaction, the polymer-rich outer region forms a co-ionically cross-linked polymer-rich outer region 180 of polymers A and B with salt bridges between chains of polymers A and/or B with additive 190 in the additive-rich core region encapsulated therein.

After the reaction, the encapsulated additives can then be skimmed or filtered out of the multivalent cation solution. Next, if desired, the encapsulated additives can be rinsed to remove excess multivalent cations.

Additionally, the encapsulated additives can also be dried, wherein after the encapsulated additives are dried, they can be used as desired, such as inserted or mixed into tobacco. Preferably, the encapsulated additives are dried in a vacuum at a temperature less than 70° C.; however, the encapsulated additives may also be subjected to air flow and elevated temperatures for drying as long as volatilization of the encapsulated additives is avoided. As a result, encapsulated additives with a cross-linked matrix of encapsulant with additives therein are formed.

It is noted that the additive 190 can be anywhere within the encapsulated additive 170, but is primarily within an additive-rich core region 190 due to the surface segregation and aggregation of the additive within a central region upon droplet formation. Therefore for purposes of illustration, the additive is illustrated in FIG. 1 as a central region 190 of the encapsulated additive 170.

It is also noted that the encapsulated additive overall includes additive and encapsulant throughout, wherein the area surrounding the additive-rich core 190 is a polymer-rich outer region 180 since the additive will primarily be in the core region leaving the encapsulant with less additive toward the outer region.

Also, depending upon the degree of hydrophobicity of the additive solution (including an emulsifier, if used), the additive can be more or less concentrated toward a central core region.

By using polymer A and polymer B solutions along with an additive, an encapsulated additive can be formed with two cross-linkable polysaccharides co-ionically cross-linked with one another and additive encapsulated therein. As such, polymer A is preferably selected to be cross-linkable with polymer B. For example, pectin and alginate are co-ionically cross-linkable and can be used together to encapsulate an additive. It is noted that filler polymers, such as xanthan gum and polyethylene glycol, can be used, but will not co-ionically cross-link.

It is also noted that by using two or more co-cross-linkable polymers, the stability of the encapsulated additive can be increased and the porosity of the co-cross-linked polymers can be decreased. These features can lead to an improved resistance to migration for the additive, wherein the encapsulated additive can be leak resistant and can maintain high levels of additive prior to heating of the polymers to release the additives.

2. In-situ Overcoating

In addition to or in substitute of CICL, in-situ over-coating may be used to form encapsulated additives. In-situ over-coating ("ISOC") is intended herein to include an inward to outward cross-linking direction of encapsulated additives rather than an outward to inward cross-linking direction, which is the direction of CICL. In order to accomplish this, ISOC provides for an initial mixture of a multivalent cation solution and an additive solution, which is reacted with a polymer solution. By providing multivalent cations rather than one or more polymers in the initial mixture, the one or more polymers cross-link with the multivalent cations from a core region outward which is another method that can be used to form encapsulated additives.

Additionally, similar to CICL, ISOC can also use surface segregation to form an additive-rich core region, wherein the additive is preferably hydrophobic and the multivalent cation solution and the polymer solution are preferably water based.

Figure 2:
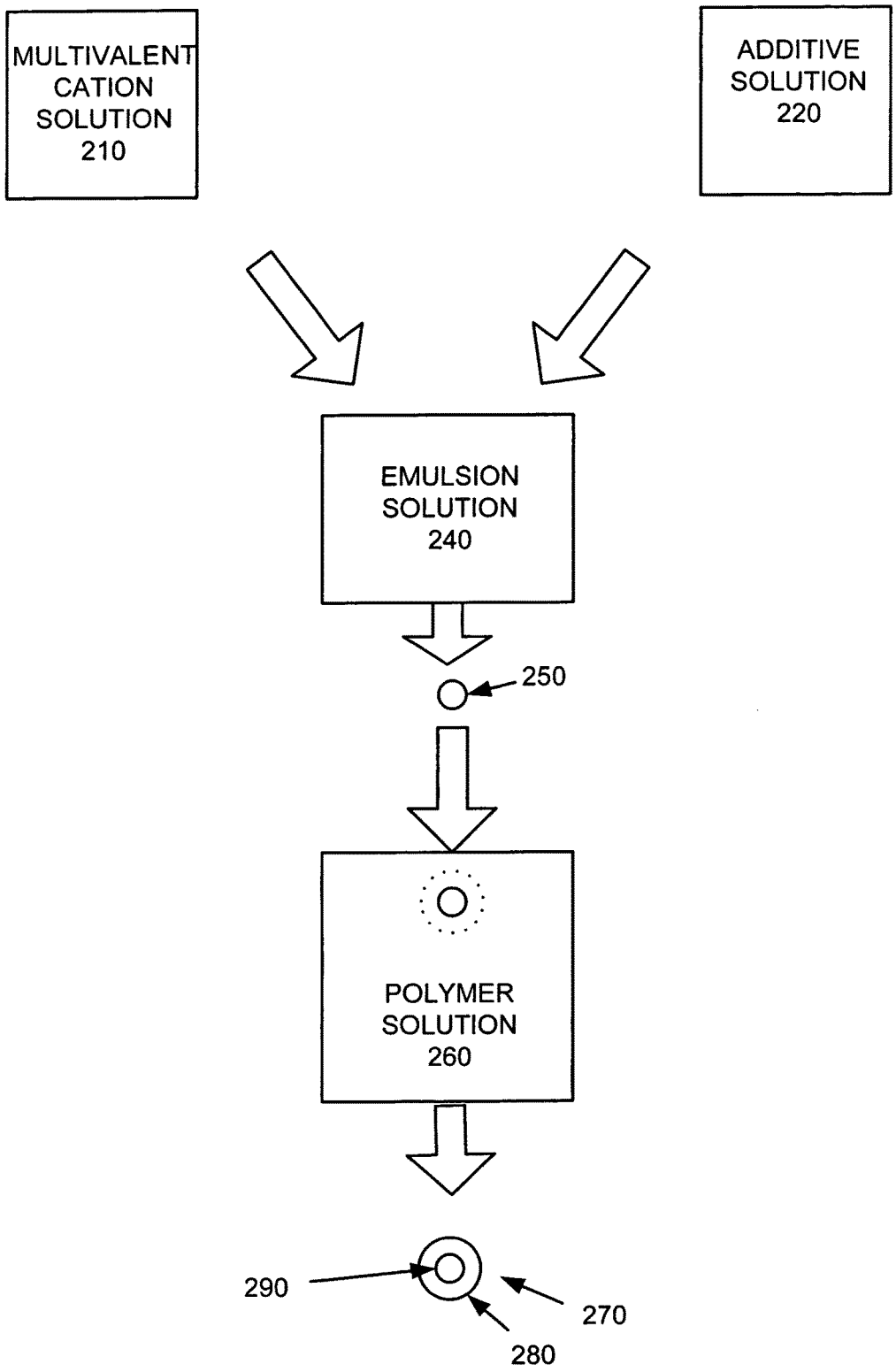
FIG. 2 is a simplified illustration of an exemplary in-situ overcoating encapsulation method.

For example, as illustrated in FIG. 2, a multivalent cation solution 210 of multivalent cations in a water base solution is mixed with an additive solution 220 to form an emulsion solution 240. Preferably, both the multivalent cation solution 210 and the additive solution 220 are similar to those used in the CICL method, as discussed above, wherein the additive solution 220 is a hydrophobic solution of menthol with oil as an emulsifier.

Next, the emulsion solution 240 is subjected to high speed mixing to form a relatively homogeneous mixture of additive and multivalent cations in a water base solution. Next, a droplet 250 can be formed. It is noted that the droplet, similar to that of a CICL droplet, includes surface segregation between a hydrophobic additive solution 220 and a water base solution this time with multivalent cations rather than polymers, wherein the hydrophobic additive solution forms additive-rich core regions within the multivalent cation solution due to the surface segregation within each droplet. Additionally, the additive solution preferably includes menthol and oil, and the multivalent cation solution preferably includes calcium chloride in a water base solution.

The droplet 250 is then placed in contact with a polymer solution 260 to form encapsulated additives 270. It is again noted that the cross-linking by the multivalent cations in the droplet 250 react with polymers from the polymer solution 260 within a few seconds, i.e., 1-10 seconds.

It is noted that the reaction between the droplet 250 and the polymer solution 260 causes the polymers in the polymer solution 260 to penetrate the outer multivalent cation-rich outer region of the droplet and cross-link from a central portion near an additive-rich core region of the droplet moving outward using the multivalent cations in the droplet 250 to propagate the cross-linking. In other words, the polymers in the polymer solution 260 cross-link from an additive-rich core region outward replacing the multivalent cation-rich outer region of the droplet with a cross-linked polymer-rich outer region. This is contrary to CICL which forms from an outer portion of a droplet inward.

It is noted that similar components are used for ISOC and CICL in that the polysaccharides and multivalent cations are preferably employed to encapsulate additives, such as menthol, wherein the cross-linked polymer 280 is also cross-linked using salt bridges formed by the multivalent cations, wherein the encapsulated additive includes a polymer-rich outer region with an additive-rich core region 290 therein.

Also, it is again noted that similar to FIG. 1, the additive 290 is illustrated in FIG. 2 as a central portion of the encapsulated additive 270; however, the additive can be anywhere within the encapsulated additive 270 due to the hydrophobic additive interaction with the water base multivalent cation solution in droplet form. Therefore for purposes of illustration, the additive is illustrated in FIG. 2 has a central region 290 of the encapsulated additive 270.

It is noted that the ISOC method can be used with one or more polymers in the polymer solution 260. Additionally, in both the ISOC and the CICL methods, more than one multivalent cation can be used in the multivalent cation solution 210 and one or more additives may be used in the additive solution 220. Thus, if more than one polymer is used in the polymer solution 260, CICL of two or more polymers can be achieved within an ISOC process, wherein the process would remain inward to outward in cross-link formation due to the use of the multivalent cation containing mixture being placed in contact with a polymer solution including two or more polymers therein.

3. Step-growth Overcoating

In addition to CICL and ISOC, step-growth overcoating or step-growth layering ("SGO") may be used in encapsulated additive formation. In SGO, different materials can be applied to form at least one overcoat on an encapsulated additive, and thus create further barriers to leakage and migration. In this way, encapsulated additives can be made more stable and leak resistant than non-overcoated encapsulated additives.

Figure 3:
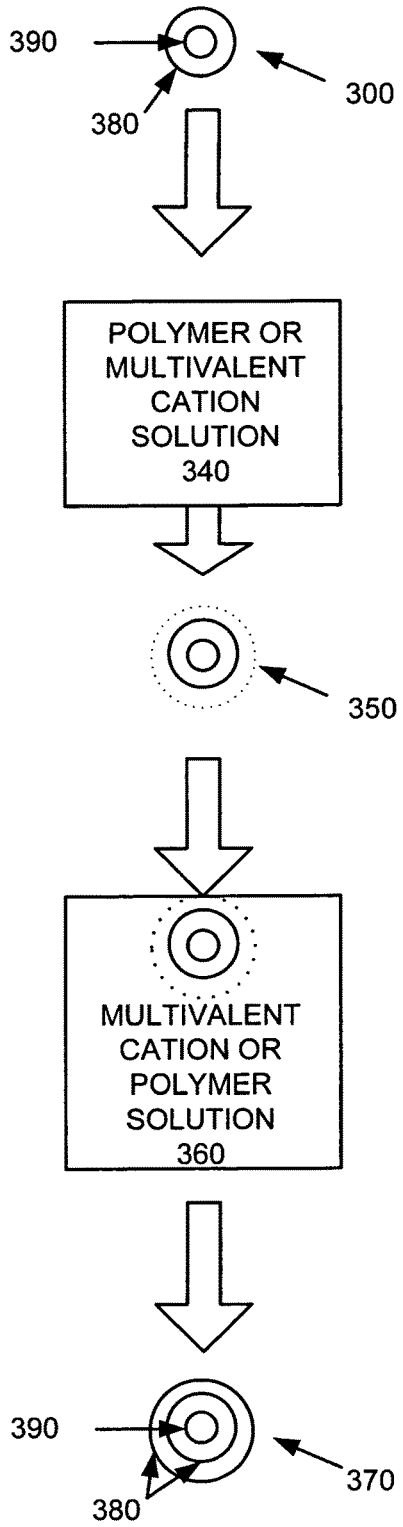
FIG. 3 is a simplified illustration of an exemplary step-growth layering encapsulation method.

SGO includes forming polymer layers on pre-encapsulated additives. In other words, one or more shell layers are formed on an outer surface of an encapsulated additive. For example, as illustrated in FIG. 3, an already encapsulated additive 300 with an encapsulant-rich and an additive-rich portion, which can be formed according to the methods listed above, such as CICL or ISOC, or any other method is first provided.

Next, the encapsulated additive 300 is at least partially coated with either a polymer or a multivalent cation solution 340 to form a coated encapsulated additive 350. The coated encapsulated additive 350 can include a wet coating layer of a polymer solution or a multivalent cation solution thereon. Next, the coated encapsulated additive can be removed from the solution 340 and placed into a secondary reactive solution 360. It is noted that the coating on the encapsulated additive is preferably still wet to enhance reaction with the secondary reactive solution, however, the coating can be dried if desired.

Next, the coated encapsulated additive 350 is reacted with a secondary reactive solution 360 to form a shell layer on the encapsulated additive 300, wherein the secondary reactive solution 360 is a complementary reactive solution with the solution 340. For example, if solution 340 is a polymer solution, then the secondary reactive solution 360 is a multivalent cation solution which cross-links the polymer solution to form a shell layer on the encapsulated additive 300 from an outer to an inner direction. On the other hand, for example, if the solution 340 is a multivalent cation solution, then the secondary reactive solution 360 is a polymer solution which forms a shell layer on the encapsulated additive 300 from an inner to an outer direction. Alternatively, multivalent cations used to form the encapsulated additive 300 can be used with a coating of a polymer solution to form an outer shell layer on the encapsulated additive, wherein a second application of multivalent cations is optional.

As a result of the reaction of the coated encapsulated additive 350 with the secondary reactive solution 360 (or reactive solutions remaining from the encapsulated additive 300), an over-coated encapsulated additive 370 can be formed with an additive-rich core 390 surrounded by a polymer-rich outer region and a shell layer 380 of cross-linked polymers thereon. It is noted that the over-coated encapsulated additive can be made more stable and leak resistant due to the additional shell layer thereon which can fill voids and fissures of the encapsulated additive alone 370 and due to added encapsulation properties provided by the shell layer.

Additionally, after forming an over-coated encapsulated additive 370 with a shell layer on the encapsulated additive, the over-coated encapsulated additive 370 can be repeatedly over-coated to form additional shell layers on the shell layer 380. If multiple shell layers are desired, the over-coated encapsulated additive can remain wet from the secondary reactive solution 360 and can be placed into solution 340 again or any other coating solution, then reacted with a complementary reactive solution. Thus, multiple shell layers of similar or different polymers can be applied to the encapsulated additive to form an over-coated encapsulated additive.

Additionally, SGO can be used more than once on encapsulated additives. For example, the encapsulated additive can be subjected to multiple SGO processes and thus have multiple polymer layers on the encapsulated additive. In addition to the benefits of having an additional layer provided on an encapsulated additive, preferably, different polymers are used for an outer layer. Additionally, different polymers can be used for each subsequent shell layer, which can provide improved encapsulant characteristics.

By providing a second polymer, different from the encapsulant first polymer, complementary properties from the second polymer can also be achieved. For example, alginate can be used to encapsulate an additive initially and pectin can be used to provide an additional layer on the alginate encapsulated additive, wherein the pectin can increase the resistance to migration of additive from the encapsulation by filling in naturally occurring voids and/or fissures, therefore providing two shell layers on an encapsulant-rich portion of an encapsulated additive.

In addition to using SGO to form one or more shell layers on a pre-encapsulated additive, SGO can also be used to encapsulate or seal in the inherent tobacco flavor of a tobacco mat therein or to incorporate an encapsulated additive into a tobacco mat. Preferably, SGO can be used to seal the tobacco mat by forming a shell layer on the tobacco mat. Also preferably, SGO can be used to incorporate encapsulated additives into a tobacco mat by sealing the tobacco mat with a film including encapsulated additives therein.

For example, when using SGO with a tobacco mat, a polymer coating with or without encapsulated additives can be applied to the tobacco mat. Preferably, the polymer coating is applied by spraying the polymer coating onto a tobacco mat, wherein encapsulated additives can merely be present in the polymer coating or an additive can be mixed at high speeds with the polymer coating to form a relatively homogeneous polymer-additive coating.

Next, a multivalent cation solution, such as $CaCl_2$ solution, can be sprayed onto the polymer coating to cause a cross-linking reaction between the polymer coating and the multivalent cation solution to form a cross-linked polymer film. Thus, if encapsulated additives were added to the polymer coating, the encapsulated additives will be fastened onto the tobacco mat by the polymer coating. Alternatively, if a polymer-additive coating was applied, then the additive would be encapsulated within a matrix of a cross-linked polymer film on the tobacco mat. Next, if desired, additional coating layers may be used to form a multi-layer film.

Alternatively, in a reverse method, a multivalent cation solution can be added to a coating formulation and applied to the tobacco mat, wherein encapsulated additive or non-encapsulated additive may also be added to the coating formulation. Next, the tobacco mat can be sprayed with a polymer solution to form a cross-linked polymer film on the tobacco mat with encapsulated additives within the polymer film or additives encapsulated within a matrix of the cross-linked polymer film on the tobacco mat. It is noted that the polymers and multivalent cations used in the CICL, ISOC and SGO methods can similarly be used here to coat the tobacco mat.

Smoking Article

It is envisioned that encapsulated additives made by the methods discussed above may be used in smoking articles, wherein the characteristics of the encapsulated additives may be utilized. Examples of smoking articles which utilize encapsulated additives therein include cigarettes, including traditional cigarettes with tobacco filler in tobacco rods and non-traditional cigarettes with tobacco mats. Preferably, the cigarettes utilize the encapsulated additives with filters including sorbents.

The terms "smoking articles" and "tobacco products" include cigarettes, pipes and cigars. Non-traditional cigarettes such as cigarettes for electrical smoking systems are also included in the definition of smoking articles or cigarettes generally.

A traditional cigarette typically contains two sections, a tobacco-containing portion sometimes referred to as the tobacco or cigarette rod, and a filter portion which may be referred to as a filter tipping. Tipping paper typically surrounds the filter, which forms the mouth end of the cigarette. The tipping paper overlaps with the tobacco rod in order to hold the filter and tobacco rod together. The tobacco rod, or tobacco containing element of the cigarette, includes the paper wrapper in which the tobacco is wrapped and the adhesive holding the seams of the paper wrapper together. The tobacco rod has a first end which is integrally attached to the filter and a second end which is lit or heated for smoking the tobacco. When the tobacco rod is lit or heated for smoking, the smoke travels from the lit end downstream to the filter end of the tobacco rod and further downstream through the filter.

Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636, the disclosures of which are incorporated by reference herein in their entireties.

In accordance with one embodiment, one or more encapsulated additives are incorporated in a smoking article, such as a cigarette, wherein a filter employed in the cigarette includes at least one sorbent (absorbent or adsorbent). Preferably, the encapsulated additive is located in tobacco fill of the smoking article, wherein the encapsulated additive will be exposed to heat and moisture from smoke formed smoking of the smoking article.

As used herein, a "sorbent" is a substance that has the ability to condense or hold molecules of one or more tobacco smoke constituents on its surface and/or the ability to take up such components, i.e., through penetration into its inner structure or into its pores. The term "sorbent" as used herein refers to an adsorbent, an absorbent, or a substance that can function as both an adsorbent and an absorbent. The term "sorption" is intended to encompass interactions on the outer surface of sorbents such as activated carbon, zeolite and other like materials, as well as interactions within the pores and channels thereof.

Suitable sorbents include various forms of activated carbon, molecular sieves, such as zeolites, and mixtures thereof. Activated forms of carbon have strong physical adsorption forces, and high volumes of adsorbing porosity. The activated carbon could be manufactured by any suitable technique. One technique is the carbonization of coconut husk, coal, wood, pitch, cellulose fibers, or polymer fibers, for example. Carbonization is preferably carried out at high temperatures, i.e., 500-900° C. in an inert atmosphere, followed by activation under reducing conditions. The activated carbon used in the smoking articles could be in the form of monolithic shapes, granules, beads, powders or fibers. If desired, the activated carbon can be incorporated in another material such as paper.

Activated carbon may include a distribution of micropores, mesopores and macropores. The term "microporous" generally refers to such materials having pore sizes of about 20 Å or less while the term "mesoporous" generally refers to such materials with pore sizes of about 20 to 500 Å. The term "macroporous" refers to pore sizes above 500 Å. The relative amounts of micropores, mesopores and macropores can be pre-selected relative to the selected components from mainstream tobacco smoke that are to be targeted and removed. Thus, the pore sizes and pore distribution can be adjusted accordingly as needed for a certain application.

Another material which may be used as a sorbent in the filter system of the smoking article is a molecular sieve zeolite. The term "molecular sieve" as used herein refers to a porous structure composed of an inorganic silicate material. Zeolites have channels or pores of uniform, molecular sized dimensions. There are many known unique zeolite structures having different sized and shaped channels or pores. The size and shape of the channels or pores can significantly affect the properties of these materials with regard to adsorption and separation characteristics. Zeolites can be used to separate molecules in the channels or pores, and/or by differences in strength of sorption. By using one or more zeolites having channels or pores larger than selected constituents of mainstream smoke, only selected molecules that are small enough to pass through the pores of the molecular sieve material are able to enter the cavities and become sorbed by the zeolite.

Zeolite-type molecular sieves which are useful in smoking articles include ZSM-5, A, X, and Y-type zeolites. Other molecular sieves which can be useful in smoking articles include silicoaluminophosphates and mesoporous molecular sieves, such as MCM-41, MCM-48 and SBA-15. These are preferably granular materials. This family of materials contains regular arrays of uniformly-sized channels and tunable internal active sites, and admits molecules below a certain size into their internal space which makes them useful as catalysts and adsorbents where selectivity is desired. Microporous, mesoporous and/or macroporous molecular sieves may be used. They are selected for use in a filter system based on the particular constituent(s) to be removed from the mainstream smoke.

The sorbent can be incorporated in one or more locations of the smoking article. For example, the sorbent can be placed in the passageway of a tubular free-flow filter component, in the material of a filter component, and/or in a void space of a filter. The sorbent can additionally or alternatively be incorporated in a tobacco material or wrapper of a smoking article.

The filter may comprise a sorbent in oriented or non-oriented fibers and a sleeve, such as paper, surrounding the fibers. The sorbent can be, for example, one or more of activated carbon, zeolite, and other molecular sieves located in fibrous forms. Sorbent mixtures can provide different filtration characteristics to achieve a targeted filtered mainstream smoke composition.

Alternatively, the sorbent can be composed of one or more sorbent materials, such as carbon, silica, zeolite and the like, impregnated in micro-cavity fibers, such as TRIAD™ micro-cavity fiber manufactured by Honeywell International of Morristown, N.J. See commonly assigned U.S. Pat. Nos. 6,584,979, 6,772,768 and 6,779,528 which are hereby incorporated by reference in their entirety. The fibers may be shaped micro-cavity fibers impregnated with particles of one or more sorbent materials.

Sorbent can be incorporated in a cigarette filter at one or more desired locations. In a preferred embodiment, a sorbent segment is combined with a free-flow filter. The sorbent can be in contact with (i.e., abut) a free-flow filter positioned between the free-flow filter and a mouthpiece filter plug or in contact with (i.e., abut) a mouthpiece filter plug. The sorbent segment preferably has a diameter substantially equal to that of the outer diameter of a free-flow filter to minimize by-pass of smoke during the filtration process.

Fibrous sorbent-containing filter segments preferably have a high loft with a suitable packing density and fiber length such that parallel pathways are created between fibers. Such structure can effectively remove selected gas-phase constituents, such as formaldehyde and/or acrolein, while preferably removing only a minimal amount of particulate matter from the smoke, thereby achieving a significant reduction of the selected gas-phase constituents, while not significantly affecting the total particulate matter (TPM) in the tobacco smoke. A low packing density and a short fiber length are preferred to achieve such filtration performance.

The amount of sorbent used in preferred embodiments of the smoking article depends on the amount of selected gas-phase constituents in the tobacco smoke and the type of constituents that is desired to be removed from the tobacco smoke.

When sorbents and additives are used in smoking articles, additives can deactivate sorbents by being sorbed within the sorbents. Thus, to reduce the level of deactivation of sorbent, additives are preferably encapsulated to reduce the interaction between the sorbent and additive prior to use of the smoking article.

A non-traditional cigarette typically contains the same two sections with a tobacco-containing portion and a filter portion, however, the tobacco portion includes a tobacco mat, which is formed inside of the paper wrapper, and a tobacco plug, which is wrapped within the tobacco mat. Typically, the tobacco mat forms a hollow tube of the cigarette which is heated by the heating blades of a non-traditional cigarette smoking system.

The term "mainstream smoke" includes the mixture of gases and/or aerosols passing down a smoking article, such as a tobacco rod, and issuing from an end, such as through the filter end, i.e., the amount of smoke issuing or drawn from the mouth end of a cigarette during smoking of the cigarette. The mainstream smoke contains air that is drawn in through the heated region of the cigarette and through the paper wrapper.

"Smoking" of a cigarette (or smoking article) means the heating, combusting or otherwise causing a release of certain chemicals from tobacco. Generally, smoking of a cigarette involves lighting one end of the cigarette and drawing the smoke downstream through the mouth end of the cigarette, while the tobacco contained therein undergoes a combustion reaction. However, the cigarette may also be smoked by other means, as mentioned above.

The encapsulated additives formed by the methods mentioned above, can be incorporated into cut filler for smoking articles, such as traditional cigarettes, cigars, pipes, or non-traditional tobacco plugs tobacco mats for use in non-traditional cigarettes, wherein the location of the encapsulated additive is selected to provide additive in the smoking article, reduce deactivation of sorbents and provide sufficient heat levels to degrade the encapsulant. By incorporating encapsulated additives into the cut filler or tobacco mat, the encapsulated additives can be exposed to heat when the smoking article is smoked and the encapsulating material is degraded to thereby release the encapsulated additives into the mainstream smoke of the smoking article.

Tobacco

Examples of suitable types of tobacco materials that may be used include, but are not limited to, flue-cured tobacco, Burley tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used.

In traditional cigarette manufacture, the tobacco is normally used in the form of cut filler, i.e., in the form of shreds or strands cut into widths ranging from about 2 mm to about 1 mm or even about 0.5 mm. The lengths of the strands range from between about 5 mm to about 80 mm. The cigarettes may further comprise one or more flavors, or other suitable additives (e.g., burn additives, combustion modifying agents, coloring agents, binders, etc.).

Additives

The term "additive" means any material or component which modifies the characteristics of an article. Any appropriate additive or combination of additives may be contained inside the one or more encapsulated additives to modify the characteristics of the encapsulated additives and the articles in which the encapsulated additives are incorporated. Such additives can include flavorants, fragrances, pharmaceuticals or combinations thereof.

In a preferred embodiment, the additives in the encapsulated additives may be added to smoking articles, such as cigarettes and may include one or more flavorants. The term "flavorant" or "flavor" may include any flavor compound suitable for being releasably disposed within encapsulated additives to enhance the taste of an article. For example, a flavorant may be added to flavor mainstream smoke produced, for example, by a smoking article.

Preferably, the flavorant is hydrophobic or oil soluble to cause surface segregation, however water soluble flavorants may also be employed. Suitable flavorants include, but are not limited to, menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, and tobacco flavor. Other suitable flavorants may include flavor compounds selected from the group consisting of an acid, an alcohol, an ester, an aldehyde, a ketone, a pyrazine, combinations or blends thereof and the like. Suitable flavorants may also be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

Encapsulated Additives

The term "releasably disposed" as used herein to refer to the containment and release of additive materials in encapsulated additives such that the additive materials are sufficiently contained to substantially avoid or minimize unwanted migration, such as, for example, during storage. This term also includes, but is not limited to, the additives in encapsulated additives being mobile enough to be released from the encapsulated additives when, for example, the encapsulated additives are heated to the point of degrading the encapsulant. For example, the additives may be released from encapsulated additives at temperatures greater than about 50, 75, 100, 200 or 500° C., preferably between 75 and 300° C.

Additionally, the encapsulated additive is preferably moisture resistant, wherein moisture has little effect on the properties of the encapsulated additive. It is believed that the cross-linking of the encapsulant does not allow moisture to enter into the polymer encapsulant, thus swelling or other characteristics caused by moisture are substantially reduced.

The encapsulated additive may be formed in a variety of physical configurations, such as spherical capsules, large capsules, small capsules, microcapsules, beads, threads, films, etc, wherein the encapsulated additive is a three-dimensional matrix of cross-linked polymer with additive therein. For example, spherical capsules, which are generally round but may also be elongated or non-uniformly spherical-like in shape, can be provided for incorporation into a tobacco rod with diameters of or less than about 10 mm, 5 mm, 1 mm, 0.5 mm, etc.

Additionally, the encapsulated additive can have any desired shape, including regular or irregular shapes, including round, square, rectangular, oval, other polygonal shapes, cylindrical, fibrous, and the like. Preferably, the encapsulated additive is provided in the form of beads or strips of film, as both are easily formed and incorporated within smoking articles.

In one embodiment, beads are provided as they can be easily incorporated into tobacco filler or tobacco mats, as desired. Beads can have various sizes depending upon desired features and the methods of formation used. Preferably, the beads are micro-beads having a maximum particle size of less than about 5 mm, 1 mm, 0.5 mm or 0.1 mm.

Decreasing the size of the beads can provide a more homogenous and controlled release of additive by providing an increased surface area and possible better distribution in the tobacco filler or tobacco mat. Additionally, by using beads, the beads can be mixed more homogeneously within the tobacco filler or sprayed on a tobacco mat, such that the beads are well distributed to provide a controlled release of the additive in the smoking article during puff cycles. The beads preferably are formed by CICL, ISOC and/or SGO, wherein the heat supplied during the smoking of the smoking article degrades the encapsulant thus releasing the additive.

Also preferably, as mentioned above, the encapsulated additive may be in the form of strips of film, wherein a flat needle is used to form the strips. This is done by mixing a solution of additive and polymer, then feeding the solution through the needle to form thin, narrow, flat strips of film. Next, the strips are reacted with multivalent cations by spraying a solution of multivalent cations thereon or passing the strips through a solution of multivalent cations, in order to cross-link the polymer. Next, the strips can be cut into lengths for incorporation into smoking articles. For example, the strips can be placed as strips of tobacco rod length along the length of a tobacco rod of a cigarette within the tobacco filler or the paper wrapper, wherein the strips can be a loose, separate layer or can be attached to the paper wrapper. As another example, the strips can be cut and incorporated into the tobacco filler.

The proportions of the encapsulating and additive components can be widely varied. The proportions are preferably balanced to provide sufficient levels of additive while also providing sufficient stability for the encapsulant. For example, the amount of additive, such as menthol, can be from about 10 to 90%, or 40-70% by weight based on 100 parts by weight of the polymer.

The amount of solvent is preferably sufficient to solubilize the additive and polymer. Preferably, oil is used to solubilize the additive. For example, a solution of 70% menthol in oil can be used. Preferably, water is used to solubilize the polymer. For example, a solution of about 1-3% sodium alginate in water can be used with a solution of 2-5% calcium chloride in water to cross-link the alginate and form a three-dimensional matrix using CICL or ISOC, or a solution of about 0.1-2.0% sodium alginate in water with a solution of 2-5% calcium chloride in water can be used for SGO.

When additive and polymer are mixed, then reacted with multivalent cations, the additive and the polymer are preferably combined in solution at high speeds to encourage homogeneity within the solution. By forming a relatively homogeneous solution of additive and polymer, relative uniformity of additive and encapsulant ratios after reaction with the multivalent cations can be achieved rendering properties of the encapsulated additive more uniform.

On the other hand, when additive and multivalent cations are mixed initially, then reacted with polymers, the additive and multivalent cations are preferably combined in solution at high speeds to encourage homogeneousness within this solution. Similarly, by forming a relatively homogeneous solution of additive and multivalent cations, relative uniformity of additive and encapsulant ratios after reaction with the polymers can be achieved rendering properties of the encapsulated additive more uniform.

Release of Additive

Preferably, by encapsulating additives, any release of the additives from the encapsulant is reduced or prevented by trapping the additives within a three-dimensional matrix of cross-linked polymer encapsulant. Also preferably, the additive is released from the three-dimensional matrix of cross-linked polymer encapsulant on demand when heated to a sufficiently high temperature, such as to degrade the three-dimensional matrix of cross-linked polymer encapsulant and thus release the additive, such as during smoking of a smoking article.

While not wishing to be bound by theory, it is believed that heating the three-dimensional matrix of cross-linked polymer encapsulant causes at least partial degradation of the matrix thus allowing for the additive to be released from the matrix. For example, temperatures between 50° C. and 900° C., or between 100° C. and 800° C. (e.g., above 25, 50, 100, 200, 300, 400, 500, 600, 700, 800° C.) can be used for releasing additive from the polymer matrix.

Consequently, without the application of heat, the additive remains stably within the encapsulant and is therefore substantially prevented from migrating in the cigarette, reacting with other substances in the cigarette or with the environment, and deactivating the sorbent present in the cigarette prior to an application of heat, which is available in a smoked cigarette.

Therefore, upon exposure to heat, the polymer can be degraded so that the additive will not be entrapped within the matrix, thus allowing for the additive to be released from the matrix.

Preferred Embodiments

It can be seen that additives can be encapsulated and provided in various physical forms which are stabilized and thus, not subject to loss through volatilization, deterioration and/or sorption by activated carbon, zeolites or other sorbents present in a tobacco product.

An exemplary embodiment of a method of making smoking articles comprises providing a cut filler or a tobacco mat to a cigarette-making machine to form a tobacco portion (e.g., a tobacco column); providing encapsulated additives to the cut filler; placing a paper wrapper around the tobacco portion to form a tobacco rod; and attaching a filter portion to the tobacco rod to form the smoking article.

Another exemplary embodiment preferably includes a cigarette which comprises an amount of the encapsulated flavorant additive formed by CICL, ISOC and/or SGO, wherein the encapsulated flavorant additive provides a desired amount of the flavoring in the cigarette. For example, provided is a cigarette which comprises, based on the total weight of tobacco in the cigarette, up to about 20%, and more preferably about 5% to about 10%, of the encapsulated flavorant additive. For example, a cigarette containing 100 mg of tobacco preferably contains up to about 20 mg of menthol.

In another exemplary embodiment, the encapsulated additive is disposed in at least one location in a cigarette that reaches at least a minimum temperature at which the flavoring is released during smoking. For example, the encapsulated product can be disposed in the tobacco, wherein heat can be used to release the flavoring.

EXAMPLE 1

In this example of CICL, menthol, oil, water, pectin and alginate are mixed to form an emulsion. Preferably, the emulsion includes an oil base menthol solution and a water base pectin and alginate solution mixed together. Preferably, the oil base menthol solution includes about 10-90% menthol in oil, 1-5% alginate in water and 1-5% pectin in water. The emulsion is then added drop-wise into a 1-5% $CaCl_2$ solution to co-ionically cross-link the pectin and alginate and entrap the menthol and oil within the cross-linked pectin-alginate encapsulation.

Additionally, a synthetic polymer, e.g., poly(acrylic acid), may be used in the emulsion as a filler polymer along with a polysaccharide. For example, menthol, oil, water, pectin, and polyacrylic acid can be made into an emulsion and dropped into $CaCl_2$ solution, thus forming a pectin and polyacrylic acid encapsulant for the encapsulated additive. By utilizing polyacrylic acid in combination with pectin, the pectin can form a three-dimensional matrix for encapsulating the menthol and oil, wherein the polyacrylic acid can fill in naturally occurring voids and fissures in the matrix to render the encapsulant more leak resistant than pectin encapsulant alone.

Amounts of the additives, emulsifiers, encapsulants, water levels and multivalent cation solutions are as listed in Table 1, wherein each of the samples resulted in encapsulated additives, which were structurally stable and additive leak resistant until heat was applied to release the additive.

TABLE 1

| | Additive | Emulsifier | Encapsulant | Water | Multivalent Cation |
|---|---|---|---|---|---|
| Sample 1 (CICL) | 5 g Menthol | 5 g Oil | 1 g Sodium Alginate + 0.5 g Pectin | 39.0 g | 5% $CaCl_2$ in water |
| Sample 2 (CICL) | 5 g Menthol | 5 g Oil | 0.5 g Sodium Alginate + 0.5 g Pectin | 39.0 g | 5% $CaCl_2$ in water |
| Sample 3 (CICL) | 5 g Menthol | 5 g Oil | 0.25 g Sodium Alginate + 0.5 g Pectin | 39.75 g | 5% $CaCl_2$ in water |
| Sample 4 (CICL) | 13.4 g Menthol | 6.6 g Oil | 3 g Pectin + 0.8 g poly(acrylic acid) | 76.4 g | 5% $CaCl_2$ in water |

EXAMPLE 2

In this example of ISOC, menthol, oil, water, multivalent cations are mixed to form an emulsion. Preferably, the emulsion includes an oil base menthol solution and a water base multivalent cation solution mixed together. Preferably, the oil base menthol solution includes about 10-90% menthol in oil and the multivalent cation solution includes 1-5% $CaCl_2$ in water. The emulsion is then added drop-wise into a pectin solution of 0.1-5% in water to co-ionically cross-link the pectin and entrap the menthol and oil within the cross-linked pectin encapsulation. Amounts of the additives, emulsifiers, encapsulants, water levels and multivalent cation solutions are as listed in Table 2, wherein the sample resulted in encapsulated additives, which were structurally stable and additive leak resistant until heat was applied to release the additive.

TABLE 2

| | Additive (g) | Emulsifier | Multivalent Cation | Water | Encapsulant |
|---|---|---|---|---|---|
| Sample 1 (ISOC) | 6.7 g Menthol | 3.3 g Oil + 0.5 g xanthan gum | 0.5 g $CaCl_2$ | 39 g | 0.5% Pectin in water |

It is noted that for higher polymer concentrations, i.e., closer to 5% pectin, the encapsulant-rich region appears to be harder as the reaction can take place at a more rapid rate than when lower polymer concentrations are employed. Also, while it is envisioned that the amount of time in which the encapsulated additive is in the encapsulant solution is about 1-15 seconds, increasing the amount of time can lead to larger encapsulant-rich regions as more encapsulant can therefore build up and cross-link on outer regions of the encapsulated additive.

EXAMPLE 3

In this example of SGO, different polymers are applied in succession to pre-formed encapsulated additives to form shell layers on the pre-formed encapsulated additives. First, encapsulated additives are provided, wherein the encapsulated additives may be formed by methods, such as CICL, ISOC or SGO, then overcoated and reacted to form multilayer encapsulated additives. For example, the encapsulated additives of Examples 1, 2, or a combination thereof can be used as starting encapsulated additives for this example. After forming the encapsulated additives from Examples 1, 2, or a combination thereof, the encapsulated additives are immersed into a 0.25 wt. % alginate solution and then into a 5 wt. % $CaCl_2$ solution to form an alginate polymer layer around the encapsulated additive of Examples 1, 2, or a combination thereof. For example, SGO encapsulated additives starting with encapsulated additives from Example 1 would include menthol-rich cores in an encapsulation cross-linked alginate-pectin polymer-rich outer region with an overcoating cross-linked alginate layer provided thereon from the immersion and cross-linking of Example 3.

Alternatively, single polymer-flavorant containing encapsulated additives, such as pectin-menthol containing encapsulated additives, can be used as the starting encapsulated additives. When immersed into a polymer solution, such as a 0.25 wt. % alginate solution, pectin-menthol starting encapsulated additives can be coated with alginate polymer layers to form alginate-pectin-menthol encapsulated additives.

As another alternative, capsules of Examples 1, 2, or a combination thereof can be immersed in a polymer solution, such as a 1 wt. % pectin solution, and while still wet with pectin solution can be immersed into a 5 wt. % $CaCl_2$ solution in order to cross-link the polymers and form a pectin polymer layer on the encapsulated additives from Examples 1, 2, or a combination thereof.

While the invention has been described in detail with reference to specific embodiments thereof, it will be apparent to one skilled in the art that various changes and modification may be made, and equivalents thereof employed, without departing from the scope of the claims.

The invention claimed is:

1. An encapsulated flavorant for placement in a smoking article so as to release flavorant when subjected to heat during smoking in the absence of mechanical force, comprising:

a hydrophobic flavorant, wherein the hydrophobic flavorant is menthol;

a hydrophilic encapsulant with the flavorant therein, wherein the encapsulant comprises two or more co-ionically cross-linked polysaccharides which forms a polymer-rich outer region and the flavorant forms a flavorant-rich core region, the two or more co-ionically cross-linked polysaccharides comprising alginate and pectin wherein voids and fissures of the alginate are filled with pectin; and at least one overcoating cross-linked polymer layer on the encapsulant polymer-rich outer region with the flavorant therein.

2. The encapsulated flavorant of claim 1, wherein the flavorant comprises an oil base menthol solution.

3. The encapsulated flavorant of claim 1, wherein the encapsulated flavorant comprises about 5 to 40 wt. % menthol.

4. The encapsulated flavorant of claim 1, wherein the overcoating cross-linked polymer layer comprises one or more polysaccharides.

5. The encapsulated flavorant of claim 1, wherein the overcoating cross-linked polymer layer comprises two or more polysaccharides.

6. The encapsulated flavorant of claim 1, wherein encapsulated flavorant includes 5 to 40% menthol, the overcoating cross-linked polymer layer comprises a cross-linked pectin layer and the encapsulated flavorant is a bead with a maximum particle size of 10 mm.

7. The encapsulated flavorant of claim 1, wherein the menthol aggregates in a gel in a core region of the matrix thus forming a menthol flavorant-rich core region.

8. The encapsulated flavorant of claim 1, wherein the encapsulant, the overcoating cross-linked polymer layer, or both are effective to retain more than about 80% of the additive within the encapsulated flavorant at temperatures below 50° C. for greater than 12 hours.

9. The encapsulated flavorant of claim 1, comprising more than one overcoating cross-linked polymer layer.

10. The encapsulated flavorant of claim 9, comprising at least two different overcoating cross-linked polymer layers.

11. The encapsulated flavorant of claim 10, wherein the at least two different overcoating cross-linked polymer layers comprise a first layer comprising alginate and a second layer comprising pectin, wherein the second layer is disposed on the first layer.

* * * * *